US009555525B2

(12) United States Patent
Wu et al.

(10) Patent No.: US 9,555,525 B2
(45) Date of Patent: Jan. 31, 2017

(54) ROTATION SPEED CONTROL METHOD FOR IMPACT TYPE FASTENING TOOLS

(71) Applicant: CHERVON (HK) LIMITED, Wanchai (HK)

(72) Inventors: Shuming Wu, Nanjing (CN); Liang Chen, Nanjing (CN); Wu Chen, Nanjing (CN)

(73) Assignee: Chervon (HK) Limited, Wanchai (HK)

( * ) Notice: Subject to any disclaimer, the term of this patent is extended or adjusted under 35 U.S.C. 154(b) by 450 days.

(21) Appl. No.: 14/264,425

(22) Filed: Apr. 29, 2014

(65) Prior Publication Data

US 2014/0352992 A1 Dec. 4, 2014

(30) Foreign Application Priority Data

May 30, 2013 (CN) ..... 2013 1 0208581

(51) Int. Cl.
*B25B 21/02* (2006.01)
*B25B 23/14* (2006.01)

(52) U.S. Cl.
CPC ..... *B25B 23/1405* (2013.01); *B25B 21/02* (2013.01)

(58) Field of Classification Search
CPC ..... B25B 21/00; B25B 21/02; B25B 21/026; B25B 21/002; B25B 21/004; B25B 23/147; B25B 23/1405; B25B 23/1475
USPC ..... 173/1, 2, 4, 176, 178, 177, 179, 181, 183,173/109, 93, 93.5, 93.6, 217; 318/34, 139, 430, 318/432, 437; 81/57.11, 57.13, 57.39, 464, 469
See application file for complete search history.

(56) References Cited

U.S. PATENT DOCUMENTS 5,154,242 A * 10/1992 Soshin ..... G05D 17/02 173/178
5,636,698 A * 6/1997 Estep ..... B25B 21/00 173/176
6,680,595 B2 * 1/2004 Ito ..... B25B 23/1405 173/11
6,836,614 B2 * 12/2004 Gilmore ..... B23P 19/066 173/176
7,235,940 B2 * 6/2007 Bosch ..... H02P 7/28 173/4
7,334,648 B2 * 2/2008 Arimura ..... B25B 21/02 173/176
7,410,006 B2 * 8/2008 Zhang ..... B23D 59/001 173/1

(Continued)

*Primary Examiner* — Scott A. Smith
(74) *Attorney, Agent, or Firm* — Greenberg Traurig, LLP

(57) ABSTRACT

A rotation speed control method for impact type fastening tools has a presetting step and a dynamic control step. The presetting step includes setting a plurality of working positions, and setting a PWM signal with a larger duty cycle as a driving signal in a period after energization so that a motor can rotate at a higher speed and improve work efficiency. When a main controller judges, according to feedback, that the operation enters an impact phase and torsion control is needed to reduce rotation speed, the main controller makes adjustment by driving the motor with a PWM signal with a lower duty cycle corresponding to a working position currently set by the user. The control method improves work efficiency, and meet the user's need of driving a fastener with a higher rotation speed at an early stage of operation. In the torsion control phase, the method according to the present invention can automatically use a suitable torsion to drive the fastener to better meet the user's needs in operation and enable the user to obtain an excellent experience of use.

10 Claims, 5 Drawing Sheets

(56) References Cited

U.S. PATENT DOCUMENTS

| | | | | |
|---|---|---|---|---|
| 7,770,658 | B2 * | 8/2010 | Ito | B23P 19/066 173/1 |
| 7,821,217 | B2 * | 10/2010 | Abolhassani | H02P 6/15 173/141 |
| 8,439,126 | B2 * | 5/2013 | Bosch | B25F 5/00 173/176 |
| 2011/0214894 | A1 * | 9/2011 | Harada | B25B 21/02 173/181 |
| 2012/0279736 | A1 * | 11/2012 | Tanimoto | B25B 21/02 173/2 |

* cited by examiner

ROTATION SPEED CONTROL METHOD FOR IMPACT TYPE FASTENING TOOLS

RELATED APPLICATION INFORMATION

This application claims the benefit of CN 201310208581.3, filed on May 30, 2013, the disclosure of which is incorporated herein by reference in its entirety.

FIELD

The subject disclosure relates to a rotation speed control method for power tools and, more particularly, to a rotation speed control method for impact type fastening tools.

BACKGROUND

Many impact type tools having torsion or rotation speed adjustment are available in the market and are used to achieve engagement between a fastener and a workpiece. Generally, when used in a fastening operation, an impact type fastening tool will have an impact fastening phase which follows a screwing phase. During a fastening operation application of a too large torsion will damage the fastener at the impact phase and application of a too small torsion will not allow completion of the fastening operation, so that the fastener and the workpiece get loose. It is for this reason that current impact type fastening tools are generally provided with several torsions or rotation speed control positions. Such control positions are generally used to drive a motor with different duty cycles, and is characterized by high rotation speed with high torsion and low rotation speed with low torsion, that is to say, a higher duty cycle will result in a higher rotation speed and torsion.

FIG. 1 illustrates a relationship diagram showing a change over time of rotation speeds (and accordingly torsion) at different rotation speed control positions of current impact type fastening tools. As shown in FIG. 1, each rotation speed control position comprises a stage in which the rotation speed (and accordingly torsion) rises slowly along with the current of the motor during an initial start period. After a designated position is reached, the rotation speed is output constantly at a constant value set according to the rotation speed control position.

In actual application, there usually occurs such a problem that a user selects a control position of rotation speed or torsion to obtain a suitable torsion at the impact phase as shown in FIG. 1, and the impact type fastening tool will achieve the driving according to the rotation speed. To prevent the fastener from being damaged due to too large a torsion, the user sets a safe and relatively low torsion, and a corresponding rotation speed is a relatively low rotation speed. However, such rotation speed and torsion waste efficiency for the screwing phase.

Currently, there is not yet a rotation control method for allowing for efficient rotation before entry into the impact phase and allowing for a switch to a suitable rotation speed to obtain a suitable torsion after automatic judgment of entry into the impact phase.

SUMMARY

To address the drawbacks of the prior art, an objective of the rotation speed control described hereinafter is to allow for efficient rotation upon idle running and in an early stage of loaded operation and to allow for automatic judgment in a later stage of the loaded operation and to shift to a suitable rotation speed to obtain a sufficiently large torsion.

The method may be implemented in an exemplary hardware configuration in which:

A motor is configured to convert electrical energy to a desired torque.

A power supply is configured to supply electrical energy to the motor.

An electronic switch is configured to control the motor to rotate or stop.

A main controller is configured to drive the electronic switch via a signal after pulse-width modulation (PWM), and to be responsible for data processing, judgment and signal detection.

A feedback means is configured to collect actual physical quantities constituting a trigger and convert them into a feedback signal that can be received and processed by the main controller. The feedback means transmits the feedback signal to the main controller for judgment of the main controller.

A trigger switch is generally responsible for on and off and magnitude adjustment of the power supply, i.e., the trigger switch can be used to control on or off of the power supply of a circuitry consisting of the electronic switch and the motor, and a magnitude of the current. The trigger switch is pulled to turn on the power supply, and the trigger switch is released to cut off the power supply. The greater an external force applied to the trigger switch is, the larger the current is. When the trigger switch is pulled to the maximum extent, a maximum current is introduced.

On the basis of the above hardware, a described method may employ the following two technical solutions:

In a first solution, the method performs steps for presetting and dynamic control. The presetting steps include setting a working position by the user operating a working position means, a main controller being able to identify the user-set working position through the working position means, each working position having a corresponding PWM signal, different PWM signals having different duty cycles, one PWM signal with a maximum duty cycle being a maximum driving signal, the PWM signal being used to drive an electronic switch, the electronic switch being used to control a motor to rotate or stop, a trigger switch controlling a magnitude of current of the motor, and a criterion for judging when to end up the efficient driving being pre-stored in the main controller.

Dynamic control after the trigger switch energizes the motor comprises the following steps:

(1) efficient driving: wherein the main controller drives the electronic switch with an efficient signal having a predetermined duty cycle to thereby drive the motor into rotation; when a working position other than the maximum working position is selected, the duty cycle of the efficient signal is greater than the duty cycle of the driving signal of the selected working position; meanwhile, the main controller enters a feedback signal detection state, a feedback means collects actual physical quantities constituting a trigger and converts them into a feedback signal that can be received and processed by the main controller, and then the method proceeds to step (2);

(2) impact judgment: wherein the main controller judges the feedback signal received by it; when the feedback signal accords with the pre-stored criterion, the method proceeds to step (3); if the feedback signal does not accord with the pre-stored criterion, step (1) continues to be executed;

(3) working position shifting: wherein according to a working position set in real time by the user, the main controller shifts to use a PWM signal corresponding to the working position to drive the electronic switch and thereby drive the motor until the trigger switch shuts off the power supply.

According to the above first solution, no matter which working position is set by the user, the main controller with an efficient signal greater than or equal to an ordinary PWM signal drives the electronic switch to obtain a relatively higher rotation speed to improve efficiency.

As a special case, in the first solution, the duty cycle of the efficient signal is equal to that of the maximum driving signal. If the duty cycle of the efficient signal is equal to that of the maximum driving signal, and the fastening tool is operating at the working position corresponding to the maximum driving signal in real time, the dynamic control will no longer perform feedback signal detection in step (1), and instead driving is provided with the maximum driving signal all the way until the trigger switch shuts off the power supply.

In the second solution, the method performs presetting and dynamic control. The presetting comprises the following steps: a user setting a working position by operating a working position means, a main controller being able to identify the user-set working position through the working position means, each working position comprising more than one ordinary working positions and a maximum working position corresponding to a maximum duty cycle driving, each of the ordinary working positions comprising an efficient PWM signal and a working PWM signal, the duty cycle of the efficient PWM signal being greater than the duty cycle of the working PWM signal in the same working position, the maximum working position having a maximum PWM signal and a maximum working PWM signal, the maximum PWM signal being greater than or equal to the maximum working PWM signal, the efficient PWM signal, the working PWM signal, the maximum PWM signal and the maximum working PWM signal being used by the main controller to drive the electronic switch, the electronic switch being used to control a motor to rotate or stop, a trigger switch controlling a magnitude of current of the motor, and a criterion for judging when to end up the efficient driving being pre-stored in the main controller.

The dynamic control after the trigger switch energizes the motor comprises the following steps:

(1) efficient driving: wherein the main controller identifies the user-set working position and drives the electronic switch with the efficient PWM signal or maximum PWM signal of the working position; meanwhile, the main controller enters a feedback signal detection state, and a feedback means collects actual physical quantities constituting a trigger and converts them into a feedback signal that can be received and processed by the main controller, and then the method proceeds to step (2);

(2) impact judgment: wherein the main controller judges the feedback signal received by it; when the feedback signal accords with the pre-stored criterion, the method proceeds to step (3); if the feedback signal does not accord with the pre-stored criterion, step (1) continues to be executed; and (3) working position shifting: wherein according to a working position set in real time by the user, the main controller shifts to use the corresponding working PWM signal or maximum working PWM signal of the working position to drive the electronic switch and thereby drive the motor until the trigger switch shuts off the power supply.

According to the second solution, a corresponding PWM signal for improving efficiency and a PWM signal capable of providing an applicable torsion are set for each working position. The advantage of so doing lies in smaller impact upon shifting, shorter shifting time and timely response.

Meanwhile, the maximum working position among the working positions is generally identical with other ordinary working positions, but as an particular case, if the duty cycle of the maximum working PWM signal of the maximum working position is equal to that of the maximum PWM signal, responsive to the maximum working position the main controller drives the electronic switch only with the maximum PWM signal until the trigger switch shuts off the power supply, no longer performing the dynamic control. That is to say, the dynamic control is not used to reduce the duty cycle.

Particularly, as a specific solution of the feedback means, the first solution accords with the second solution, and in both solutions, current, sound or distance may be collected as the feedback signal.

Illustration is presented by taking the first solution as an example.

In step (1), the feedback means collects current values of the motor for a current detecting apparatus to form a feedback signal, and in step (2), the main controller performs differential processing to the current value in real time, and when the real-time differential value satisfies a criterion pre-stored in the main controller, the method proceeds to step (3).

Or, in step (1) the feedback means is a sound collecting apparatus and it collects impact noise sent by a transmission mechanism to form a feedback signal, in step (2) the main controller judges occurrence times or sound volume of the impact noise; when the accumulated times exceed the times pre-stored in the main controller and served as the criterion, the method proceeds to step (3); or when real-time sound volume exceeds a sound volume value pre-stored in the main controller and served as the criterion, the method proceeds to step (3).

Or, in step (1) the feedback means is a distance measuring means, and it collects a real-time distance between the electrical tool and the workpiece to form a feedback signal; in step (2) the main controller performs judgment to the real-time distance: when the real-time distance is less than a distance pre-stored in the main controller and served as a criterion, the method proceeds to step (3).

The control methods that are described may better improve work efficiency, and meet the user's need of driving the fastener with a higher rotation speed at an early stage of operation; in the torsion control phase, the methods that are described can automatically use a suitable torsion to drive the fastener to better meet the user's needs in use and enable the user to obtain an excellent operation experience.

DETAILED DESCRIPTION

A first described method provides presetting and dynamic control. The presetting steps comprise a user setting one or more of a plurality of working positions by operating a working position means, such as a knob or a dial, a main controller being able to identify the user-set working position through the working position means, each working position having a corresponding PWM signal where different PWM signals having different duty cycles and one PWM signal with a maximum duty cycle being a maximum driving signal, the PWM signal being used to drive an electronic switch, the electronic switch being used to drive a motor into rotation, a trigger switch controlling a magnitude of current introduced to the motor, and a criterion for judging when to end up the efficient driving being pre-stored in the main controller.

Figure 3:
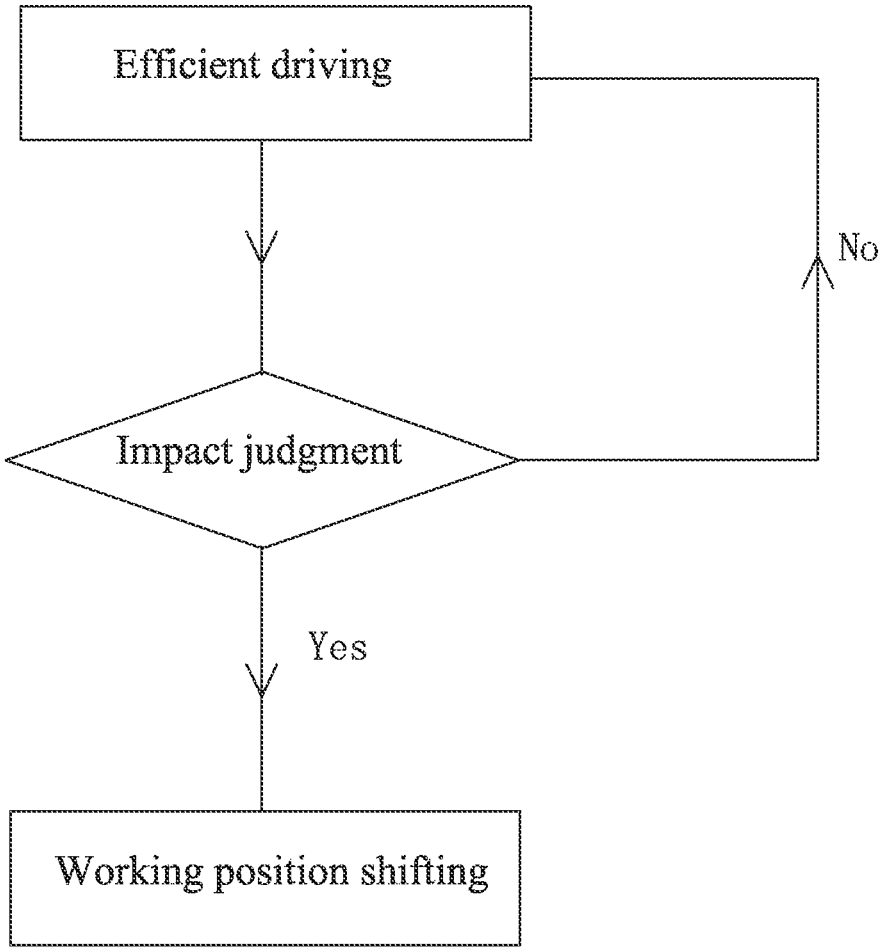
FIG. 3 illustrates a logic block diagram of dynamic control of a rotation speed control method according to the description which follows.
Figure 4:
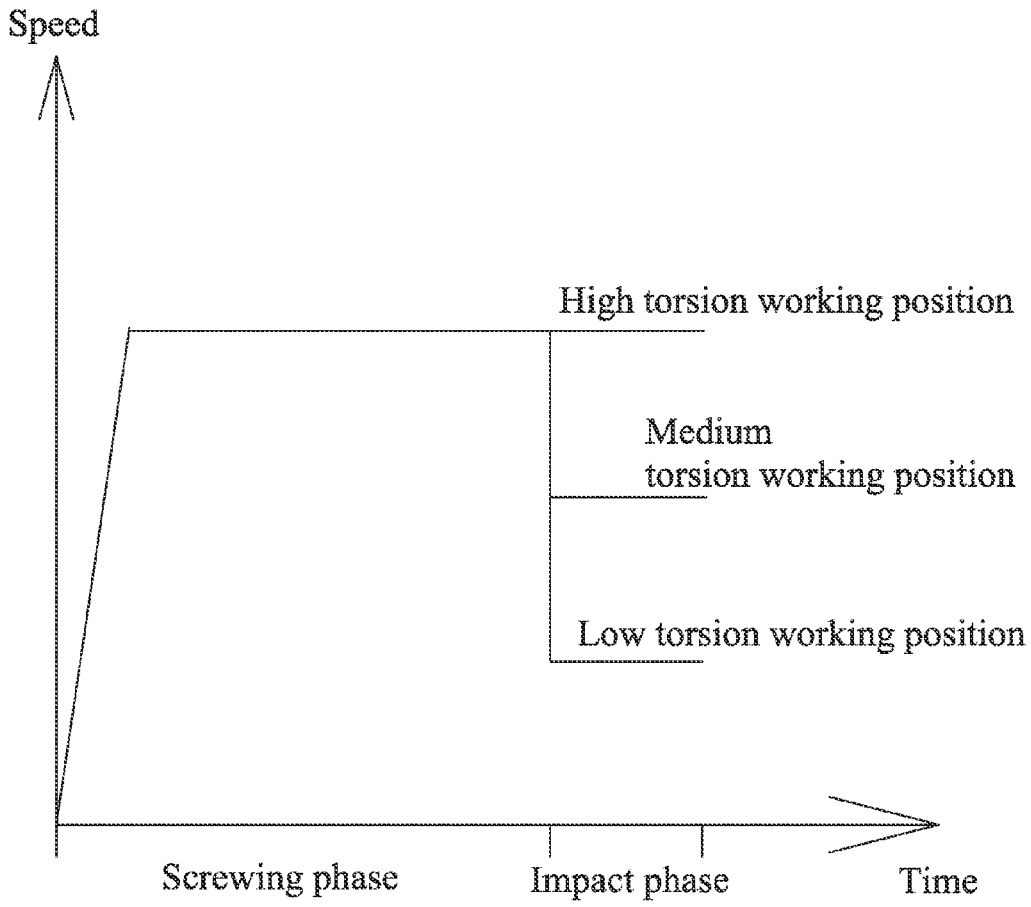
FIG. 4 illustrates a relationship diagram in which a rotation speed changes along with time in a first described control method.

Referring to FIG. 3 and FIG. 4, dynamic control after the trigger switch energizes the motor comprises the following steps:

(1) efficient driving: the main controller drives the electronic switch with an efficient signal having a predetermined duty cycle and thereby drives the motor into rotation; when a working position other than the maximum working position is selected, the duty cycle of the efficient signal is greater than the duty cycle of the driving signal of the selected working position; meanwhile, the main controller enters a feedback signal detection state, a feedback means collects actual physical quantities constituting a trigger and converts them into a feedback signal that can be received and processed by the main controller, and then the method proceeds to step (2);

(2) impact judgment: the main controller judges the feedback signal received by it; when the feedback signal accords with the pre-stored criterion, the method proceeds to step (3); if the feedback signal does not accord with the pre-stored criterion, step (1) continues to be executed;

(3) working position shifting: according to a working position set in real time by the user, the main controller shifts to use a PWM signal corresponding to the working position to drive the electronic switch and thereby drive the motor until the trigger switch shuts off the power supply.

As a preferred solution of the first solution, if the duty cycle of the efficient signal is equal to that of the maximum driving signal and the fastening tool is operating at the working position corresponding to the maximum driving signal, the dynamic control will no longer perform feedback signal detection in step (1), and instead driving is provided with the maximum driving signal all the way until the trigger switch shuts off the power supply.

Figure 5:
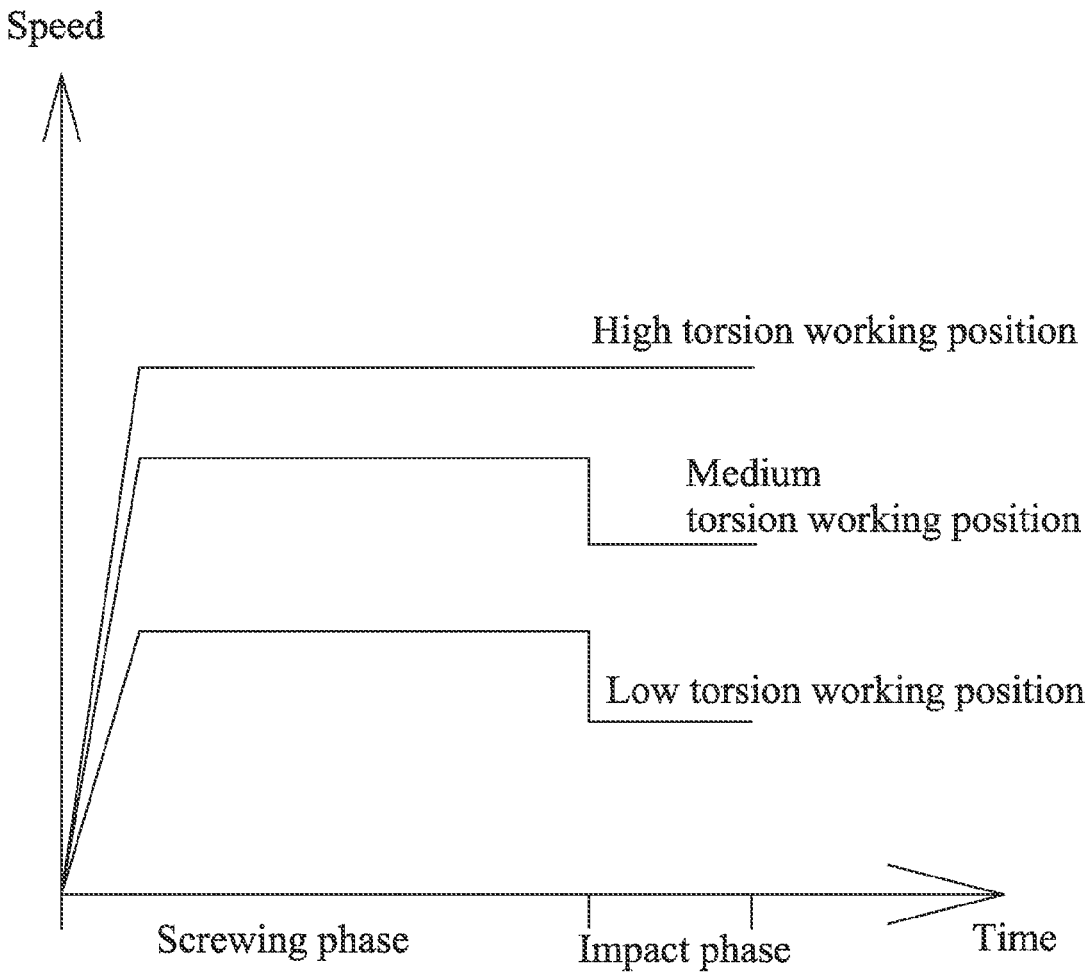
FIG. 5 illustrates a relationship diagram in which a rotation speed changes along with time in a second described control method.

Referring to FIG. 5, in the second solution the method provides presetting and dynamic control. The presetting comprises the following content: a user setting one or more of a plurality of working position by operating a working position means, a main controller being able to identify the user-set working position through the working position means, each working position comprising more than one ordinary working position and a maximum working position corresponding to a maximum duty cycle driving, each of the ordinary working positions comprising an efficient PWM signal and a working PWM signal, the duty cycle of the efficient PWM signal being greater than the duty cycle of the working PWM signal in the same working position, the maximum working position having a maximum PWM signal and a maximum working PWM signal, the maximum PWM signal being greater than or equal to the maximum working PWM signal, the efficient PWM signal, the working PWM signal, the maximum PWM signal and the maximum working PWM signal being used by the main controller to drive the electronic switch, the electronic switch being used to drive a motor into rotation, a trigger switch controlling a magnitude of current introduced to the motor, and a criterion for judging when to end up the efficient driving being pre-stored in the main controller.

The dynamic control after the trigger switch energizes the motor comprises the following steps:

(1) efficient driving: the main controller identifies the user-set working position and drives the electronic switch with the efficient PWM signal or maximum PWM signal of the working position; meanwhile, and the main controller enters a feedback signal detection state, and a feedback means collects actual physical quantities constituting a trigger and converts them into the feedback signal that can be received and processed by the main controller, and then the method proceeds to step (2);

(2) impact judgment: the main controller judges the feedback signal received by it, that is, when the feedback signal accords with the pre-stored criterion, the method proceeds to step (3), and if the feedback signal does not accord with the pre-stored criterion, step (1) continues to be executed;

(3) working position shifting: according to a working position set in real time by the user, the main controller shifts to use the working PWM signal or maximum working PWM signal of the working position to drive the electronic switch and thereby drive the motor until the trigger switch shuts off the power supply.

As a preferred solution of the second solution, if the duty cycle of the maximum working PWM signal of the maximum working position is equal to that of the maximum PWM signal, responsive to the maximum working position the main controller drives the electronic switch only with the maximum PWM signal until the trigger switch shuts off the power supply, no longer performing the dynamic control.

As a common preferred solution of the first solution and the second solution, the working positions may be classified into high, medium, and low working positions according to torsion.

As a common preferred embodiment of the first solution and the second solution, the main controller sets a maximum working duration or maximum impact times; upon judging entry into the impact phase, namely, after the feedback signal satisfies the criterion, the main controller begins to keep time or count impact times; once the set working duration or maximum impact times are reached, the main controller controls the trigger switch to shut off the power supply.

There are two cases in which the trigger switch shuts off the power supply: one is that the user loosens the trigger switch and thereby shuts off the power supply according to his judgment. However, this method of operations depends on the user's experience. To prevent excessive operation by inexperienced users, this problem is solved in a way of employing a maximum working duration or maximum impact times.

As a common preferred embodiment of the first solution and the second solution, the feedback means collects current values of the motor for a current detecting apparatus to form a feedback signal; and the main controller performs differential processing for the current value in real time in a detection state, and judges whether the differential value satisfies the criterion pre-stored in the main controller.

Figure 1:
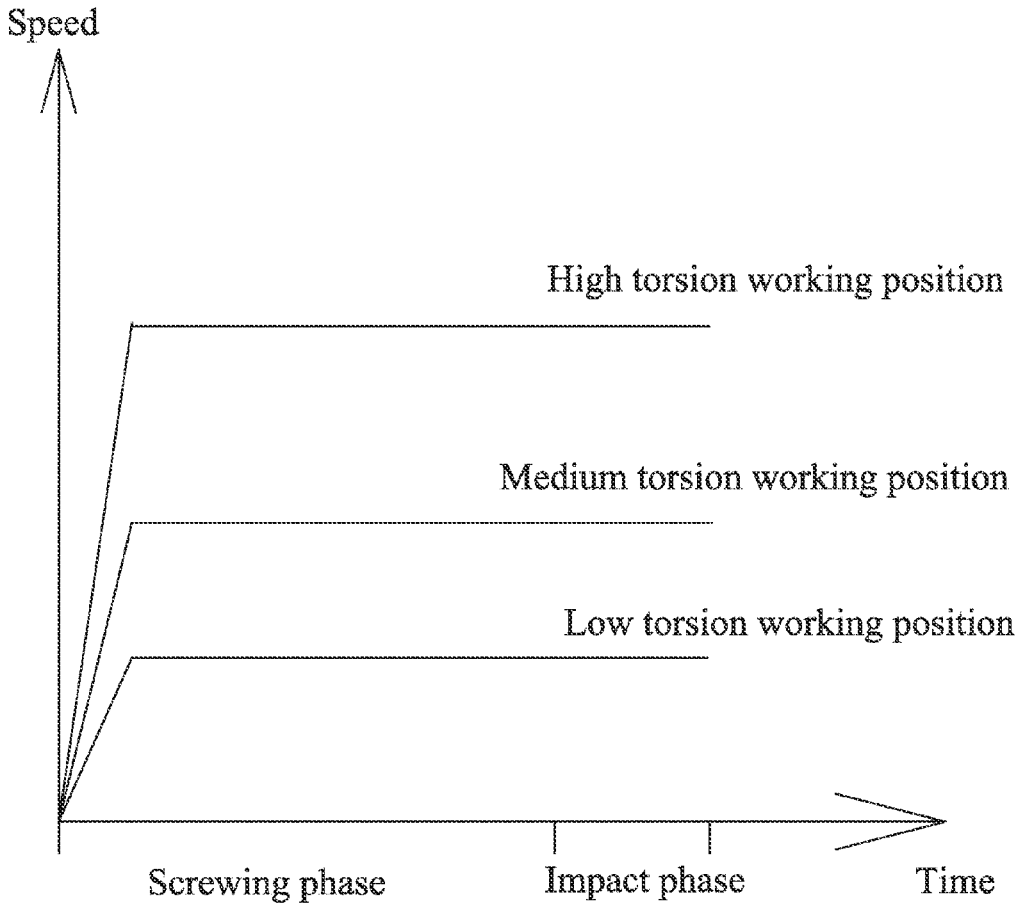
FIG. 1 illustrates a relationship diagram in which rotation speeds at different rotation speed control positions of a current impact type fastening tool change along with time.
Figure 2:
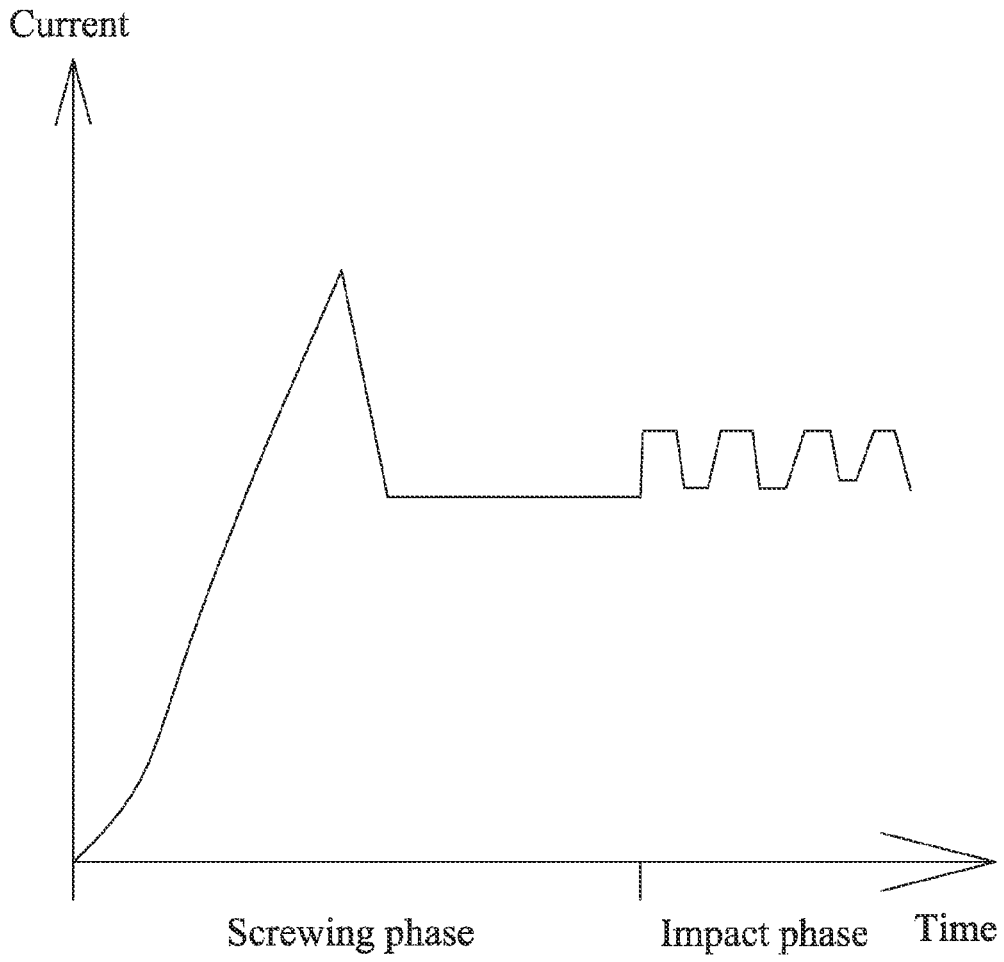
FIG. 2 illustrates a diagram showing a corresponding relationship between current of a motor and time in the current impact type fastening tool.

Before the impact judgment is performed, the dynamic control of the present invention involves driving the motor into rotation with one duty cycle, which is the same as the working mode of the motors of conventional impact type fastening tools. A specific method of using a differential value for judgment according to the present invention will be detailed as follows:

Differential processing is performed for a current value curve shown in FIG. 2 to obtain the slope at each point.

As shown in FIG. 2, it is impossible to judge whether the operation enters the impact phase directly by the current value because the current value upon entry into the impact phase has already occurred in the preceding procedure. However, a difference is found in the slope: the slope at the point upon entry into the impact phase can be distinct from the preceding slopes, and according to impact properties, this slope or an approximate slope will occur repeatedly, which allows for more accurate judgment.

Due to a dynamic control procedure, it is impossible to judge after getting complete current curve differential. The method may be employed as follows.

Assume the current curve to be fitted is represented by a linear equation: $Y=KX+b$, wherein Y represents current, X represents time, and K represents slope. If a current value Y1 is collected at X1 time point, and a current value Y2 is collected at X2 time point, $K=(Y2-Y1)/(X2-X1)$. Certainly, an actual current curve is not a straight line, but it is believed that a real-time slope sufficient to reflect actual situations can be obtained according to this method if a sampling interval is small enough and sampling frequency is high enough.

The following criterion may be employed specifically: positive-negative fluctuation times of differential values, namely, the number of turning points occurring in the function of current value versus time, is regarded as the criterion, for example, 6 times. After the positive-negative fluctuation times of differential values exceed 6 times, it is believed that the criterion is satisfied and the operation already enters the impact phase; or a range of slope value is given, and it is believed that the criterion is satisfied once the slope satisfying the range occurs for certain times.

Likewise, as a common preferred embodiment of the first solution and the second solution, the feedback means is a sound collecting apparatus and it collects impact noise sent by a transmission mechanism to form a feedback signal. The main controller judges occurrence times or sound volume of the impact noise. When the accumulated times exceed the times pre-stored in the main controller and served as the criterion, it is judged that the criterion is satisfied; or when real-time sound volume exceeds a sound volume value pre-stored in the main controller and served as the criterion, it is judged that the criterion is satisfied; or it is believed that the criterion is satisfied when the sound volume value and times need to be satisfied simultaneously.

Likewise, as a common preferred embodiment of the first solution and the second solution, the feedback means is a distance measuring means, and it collects a real-time distance between the electrical tool and the workpiece to form a feedback signal. The main controller performs judgment for the real-time distance. When the real-time distance is less than a distance pre-stored in the main controller as a criterion, it is believed that the criterion is satisfied.

The above illustrates and describes basic principles, main features and advantages of the present invention. Those skilled in the art should appreciate that the above embodiments do not limit the present invention in any form. All technical solutions obtained by employing equivalent substitution or equivalent variations all fall within the protection scope of the present invention.

What is claimed is:

1. A method for providing rotation speed control for impact type fastening tools comprising a presetting step and dynamic control step wherein the presetting step comprises setting a one of a plurality of working positions wherein the one of the plurality of working positions is set by a user operating a working position means, wherein each working position has a corresponding PWM signal, wherein different PWM signals have different duty cycles with one PWM signal having a maximum duty cycle being a maximum driving signal, and wherein each PWM signal is used to drive an electronic switch; using a main controller to identify the one of the plurality of positions set via use of the working position means; using the electronic switch to control a motor to rotate or stop, using a trigger switch to control a magnitude of current of the motor, and using a criterion pre-stored in the main controller for judging when to end efficient driving; and wherein, after the trigger switch energizes the motor, the dynamic control step comprises:

(1) using the main controller to drive the electronic switch with a signal having a predetermined duty cycle to thereby drive the motor into rotation and, when a working position other than the maximum working position is selected, the duty cycle being a signal that is greater than a duty cycle of the driving signal of the selected working position; concurrently placing the main controller into a feedback signal detection state; and using a feedback means to collect actual physical quantities constituting a trigger and converting them into a feedback signal that can be received and processed by the main controller, and then proceeding to step (2);

(2) using the main controller to judge the feedback signal received by it and when the feedback signal accords with the pre-stored criterion, proceeding to step (3) or, when the feedback signal does not accord with the pre-stored criterion, continuing to execute step (1); and (3) using a working position set in real time by the user by the main controller to cause the main controller to shift to use of a PWM signal corresponding to the working position to drive the electronic switch and thereby drive the motor until the trigger switch shuts off the power supply.

2. The method according to claim 1, wherein, when the duty cycle of the signal is equal to that of the maximum driving signal and the fastening tool is set to operate at a working position corresponding to the maximum driving signal in real time, the dynamic control will no longer perform feedback signal detection in step (1) and instead is caused to use the maximum driving signal all the way until the trigger switch shuts off the power supply.

3. The method according to claim 1, wherein, in step (1), the feedback means collects current values of the motor for a current detecting apparatus to form a feedback signal; and in step (2), the main controller performs differential processing for the current value in real time, and when the real-time differential value satisfies a criterion pre-stored in the main controller, the method proceeds to step (3).

4. The method according to claim 1, wherein, in step (1) the feedback means is a sound collecting apparatus that collects impact noise sent by a transmission mechanism to form a feedback signal; and in step (2) the main controller judges occurrence times or sound volume of the impact noise, and when the accumulated times exceed the times pre-stored in the main controller and serves as the criterion, the method proceeds to step (3); or when real-time sound volume exceeds a sound volume value pre-stored in the main controller as the criterion, the method proceeds to step (3).

5. The method according to claim 1, wherein, in step (1) the feedback means is a distance measuring means that collects a real-time distance between the electrical tool and the workpiece to form a feedback signal; in step (2) the main controller performs judgment for the real-time distance, and when the real-time distance is less than a distance pre-stored in the main controller as the criterion, the method proceeds to step (3).

6. A method for providing rotation speed control for impact type fastening tools comprising a presetting step and dynamic control step wherein the presetting step comprises setting a one of a plurality of working positions wherein the one of the plurality of working positions is set by a user operating a working position means; using a main controller to identify the one of the plurality of working positions set through the working position means wherein the plurality of working position comprise more than one ordinary working positions and a maximum working position corresponding to a maximum duty cycle driving, wherein each of the ordinary working positions comprises an efficient PWM signal and a working PWM signal, wherein the duty cycle of the efficient PWM signal is greater than the duty cycle of the working PWM signal in the same working position, wherein the maximum working position has a maximum PWM signal and a maximum working PWM signal, wherein the maximum PWM signal is greater than or equal to the maximum working PWM signal, wherein the efficient PWM signal, the working PWM signal, the maximum PWM signal and the maximum working PWM signal are used by the main controller to drive an electronic switch, and wherein the electronic switch is used to control a motor to rotate or stop; using a trigger switch to control a magnitude of current of the motor; and using a criterion for judging when to end up the efficient driving that is pre-stored in the main controller; and wherein the dynamic control step is performed after the trigger switch energizes the motor and comprises the steps of:

(1) causing the main controller to identify the user-set working position and to drive the electronic switch with the efficient PWM signal or maximum PWM signal corresponding to the working position and concurrently causing the main controller to enter into a feedback signal detection state; using feedback means to collect actual physical quantities constituting a trigger and converting them into a feedback signal that can be received and processed by the main controller, and then proceeding to step (2);

(2) using the main controller to judge the feedback signal received by it and, when the feedback signal accords with the pre-stored criterion, proceeding to step (3) and, when the feedback signal does not accord with the pre-stored criterion, causing step (1) to continue to be executed; and (c) using the working position set in real time by the main controller to cause the main controller to shift to use the working PWM signal or maximum working PWM signal of the working position to drive the electronic switch and thereby drive the motor until the trigger switch shuts off the power supply.

7. The method according to claim 6, wherein, when the duty cycle of the maximum working PWM signal of the maximum working position is equal to that of the maximum PWM signal, responsive to the maximum working position causing the main controller to drive the electronic switch only with the maximum PWM signal until the trigger switch shuts off the power supply.

8. The method according to claim 6, wherein, in step (1), the feedback means collects current values of the motor for a current detecting apparatus to form a feedback signal; and in step (2), the main controller performs differential processing for the current value in real time, and when the real-time differential value satisfies a criterion pre-stored in the main controller, the method proceeds to step (3).

9. The method according to claim 6, characterized in that, in step (1) the feedback means is a sound collecting apparatus that collects impact noise sent by a transmission mechanism to form a feedback signal; and in step (2) the main controller judges occurrence times or sound volume of the impact noise, and when the accumulated times exceed the times pre-stored in the main controller as the criterion, the method proceeds to step (3); or when real-time sound volume exceeds a sound volume value pre-stored in the main controller as the criterion, the method proceeds to step (3).

10. The method according to claim 6, wherein, in step (1) the feedback means is a distance measuring means that collects a real-time distance between the tool and the workpiece to form a feedback signal; and in step (2) the main controller performs judgment for the real-time distance, and when the real-time distance is less than a distance pre-stored in the main controller as the criterion, the method proceeds to step (3).

* * * * *